US007807094B2

(12) United States Patent
Kim et al.

(10) Patent No.: US 7,807,094 B2
(45) Date of Patent: Oct. 5, 2010

(54) PROCESS OF PREPARING CONTINUOUS FILAMENT COMPOSED OF NANOFIBERS

(76) Inventors: Hak-Yong Kim, 410-6, Pyunghwa-dong 2ga, Wansan-gu, Jeonju-si 560-865 (KR); Jong-Cheol Park, 109-1202, LG XI Apartment, 430, Ichon dong, Yongsan-gu, Seoul 140-030 (KR)

( * ) Notice: Subject to any disclaimer, the term of this patent is extended or adjusted under 35 U.S.C. 154(b) by 825 days.

(21) Appl. No.: 11/664,255

(22) PCT Filed: Nov. 12, 2004

(86) PCT No.: PCT/KR2004/002926

§ 371 (c)(1), (2), (4) Date: Mar. 30, 2007

(87) PCT Pub. No.: WO2006/052039

PCT Pub. Date: May 18, 2006

(65) Prior Publication Data

US 2008/0122142 A1 May 29, 2008

(51) Int. Cl.

| | |
|---|---|
| ***D01D 5/16*** | (2006.01) |
| ***D01D 7/00*** | (2006.01) |
| ***D01D 10/02*** | (2006.01) |
| ***D06M 10/00*** | (2006.01) |
| ***H05B 7/00*** | (2006.01) |

(52) U.S. Cl. ..... 264/465; 264/130; 264/171.1; 264/210.3; 264/210.8; 264/211.12; 264/211.14; 264/211.15; 264/211.17; 264/234

(58) Field of Classification Search ..... 264/129, 264/130, 171.1, 210.3, 210.8, 211.12, 211.14, 264/211.15, 211.17, 234, 465

See application file for complete search history.

(56) References Cited

U.S. PATENT DOCUMENTS

| | | | | |
|---|---|---|---|---|
| 4,091,140 | A | 5/1978 | Harmon | |
| 2001/0052896 | A1 | 12/2001 | Yun | |
| 2002/0089094 | A1 | 7/2002 | Kleinmeyer et al. | |
| 2002/0117770 | A1 | 8/2002 | Haynes et al. | |
| 2003/0201579 | A1 * | 10/2003 | Gordon et al. | 264/441 |

FOREIGN PATENT DOCUMENTS

| | | | |
|---|---|---|---|
| KR | 2003-8049 | A | 1/2003 |

* cited by examiner

*Primary Examiner*—Leo B Tentoni
(74) *Attorney, Agent, or Firm*—Birch, Stewart, Kolasch & Birch, LLP

(57) ABSTRACT

A method for producing a continuous filament made up of nanofibers is disclosed. A ribbon-shaped nanofiber web is prepared by electrospinning a polymer spinning solution onto a collector 7 applied with a high voltage, the collector 7 consisting of (I) an endless belt type nonconductive plate 7*a* with grooves having a predetermined width (u) and depth (h) formed at regular intervals along a lengthwise direction and a conductive plate 7*b* inserted into the grooves of the nonconductive plate, and then the nanofiber web is isolated (separated) from the collector 7, focused, drawn and wound. A continuous filament (yarn) made up of nanofibers can be produced by a simple and continuous process by providing a method for continuously producing a filament (yarn) by an electrospinning technique without a spinning process. The focusability and the drawability can be greatly improved by orienting nanofibers well in the fiber axis direction. Due to this, a continuous filament of nanofibers more excellent in mechanical properties can be produced.

15 Claims, 3 Drawing Sheets

PROCESS OF PREPARING CONTINUOUS FILAMENT COMPOSED OF NANOFIBERS

TECHNICAL FIELD

The present invention relates to a process of preparing a continuous filament or yarn (hereinafter, 'filament') composed of nanofibers, and more particularly, to a method for producing a continuous filament in a continuous process by using an electrostatic spinning technique.

In the present invention, nanofiber is a fiber with diameter less than 1,000 nm, more preferably, 500 nm.

A nonwoven fabric made up of nanofibers is applicable for a diverse range of applications such as artificial leather, filters, diapers, sanitary pads, sutures, anti-adhesion agent, wiping cloths, artificial vessels, bone fixture, etc., especially very useful for the production of artificial leather.

BACKGROUND ART

As conventional techniques for manufacturing microfibers or nanofibers suitable for the production of artificial leather or the like, a sea-island type conjugated spinning technique, a dividing type conjugated spinning technique, a blend spinning technique, etc. are known.

However, in the sea-island type conjugated spinning technique or blend spinning technique, it is necessary to dissolve out and remove one of two polymer components of a fiber for making ultrafine fibers. And, in order to produce artificial leather from fibers manufactured by these techniques, complicated processes, such as melt spinning, fiber manufacturing, nonwoven fabric manufacturing, urethane impregnation and single-component dissolution, have to be performed. Nevertheless, it is impossible to manufacture a fiber with a diameter less than 1,000 nm by the two techniques.

Meanwhile, in the dividing type conjugated spinning technique, two polymer components (e.g., polyester and polyamide) with different dyeing properties co-exist within a fiber, thus dyeing stains appear and the artificial leather production process is complicated. Further, it was difficult to manufacture a fiber with a diameter less than 2,000 nm by the above method.

As another conventional technique for producing nanofibers, an electrostatic spinning method is proposed in U.S. Pat. No. 4,323,525. In the conventional electrostatic spinning technique, a polymer spinning solution in a spinning solution main tank is continuously supplied at a constant rate to a plurality of nozzles applied with a high voltage through a metering pump, and then the spinning solution supplied to the nozzles is spun and focused on a focusing device of endless belt type applied with a high voltage more than 5 kV, thereby producing a fibrous web. The produced fibrous web is needle-punched in the subsequent process, thus to manufacture a nonwoven fabric.

As described above, the conventional electrostatic spinning technique can manufacture a web and nonwoven fabric made up of nanofibers less than 1,000 nm. Therefore, in order to produce a continuous filament by the conventional electrostatic spinning technique, it is necessary to manufacture a monofilament by cutting a prepared nanofiber web to a predetermined length and then undergo a particular spinning process by blowing it again, which makes the process complicated.

In case of nonwoven fabric made up of nanofibers, there are restrictions in applying it in a wide range of various applications such as artificial leather due to the restrictions in the intrinsic properties of the nonwoven fabric. For reference, it is difficult for the nonwoven fabric made up of nanofibers to achieve properties of more than 10 MPa.

As a conventional technique for overcoming the conventional problems, Korean Patent Application No. 2004-6402 discloses a method for producing a continuous filament made up of nanofibers in which a ribbon-shaped nanofiber web of nanofibers is manufactured by electrostatically spinning a polymer spinning solution by a collector via nozzles, then a nanofiber filament of continuous filament type is produced by giving a twist to the nanofiber web while passing it through an air twisting machine, and then a continuous filament made up of nanofibers is produced by drawing the nanofiber filament.

In the aforementioned conventional method, however, electrostatically spun nanofibers cannot be oriented in the fiber axis direction, thus the focusability and the drawability are deteriorated, thereby deteriorating the mechanical properties of the produced continuous filament.

Moreover, the aforementioned conventional method is inconvenient in that in the event of using a narrow collector or a wide collector in order to manufacture a ribbon-shaped nanofiber web, a prepared nanofiber web has to be cut to a predetermined width.

DETAILED DESCRIPTION OF THE INVENTION

Technical Objectives

The present invention provides a continuous filament composed of nanofibers by a simple process by providing a method for continuously producing a filament (yarn) by using an electrospun nanofiber web without a particular spinning process. Further, the present invention greatly improves the mechanical properties of a continuous filament by improving the focusability and the drawability by orienting nanofibers well in the fiber axis direction in an electrospinning process. Moreover, the present invention provides a method for producing a continuous filament of nanofibers excellent in properties and suitable for a variety of industrial materials such as artificial leather, filters, diapers, sanitary pads, artificial vessels, etc.

Technical Solutions

To achieve these objectives, there is provided a method for producing a continuous filament made up of nanofibers according to the present invention, wherein a ribbon-shaped nanofiber web is prepared by electrospinning a polymer spinning solution onto a collector 7 applied with a high voltage, the collector 7 consisting of (I) an endless belt type nonconductive plate 7*a* with grooves having a predetermined width (u) and depth (h) formed at regular intervals along a lengthwise direction and a conductive plate 7*b* inserted into the grooves of the nonconductive plate, and then the nanofiber web is isolated (separated) from the collector 7, focused, drawn and wound.

Hereinafter, the present invention will be described in detail. First, as shown in FIG. 1, a ribbon-shaped nanofiber web 16 is prepared by electrospinning a polymer spinning solution within a spinning solution storage tank 1 onto a collector 7 applied with a high voltage via nozzles 5 applied with a high voltage.

More concretely, the polymer spinning solution is supplied at a constant rate to the nozzles 5 arranged on a nozzle block 4 through a metering pump 2 and a spinning solution dropper 3.

At this time, in the present invention, as the collector 7 for collecting nanofibers, as shown in FIGS. 2 and 3, used is a collector consisting of (I) an endless belt type nonconductive plate 7*a* with grooves having a predetermined width (u) and depth (h) formed at regular intervals along a lengthwise direction and (II) a conductive plate 7*b* inserted into the grooves of the conductive plate, or as shown in FIG. 4, used is a collector consisting of (I) an endless belt type nonconductive plate 7*a* with grooves formed at regular intervals along a lengthwise direction and (II) a conductive plate 7*b* inserted into the grooves of the nonconductive plate, projected on the surface of the nonconductive plate and having a predetermined width (u') and height (h'), whereby the nanofibers collected on the collector are oriented well in the fiber axis direction.

FIG. 1 is a schematic view of a process using the bottom up method according to the present invention. FIG. 2 is a pattern diagram showing a process for producing a ribbon-shaped nanofiber web at a collector 7 where a conductive plate 7*b* is disposed within grooves of a nonconductive plate 7*a*. FIG. 3 is an enlarged pattern diagram of parts of the collector 7 as shown in FIG. 2.

FIG. 4 is a pattern diagram showing a process for producing a ribbon-shaped nanofiber web at a collector 7 where a conductive plate 7*b* is projected on the surface of a nonconductive plate 7*a*.

The conductive plate 7*b* of FIG. 4 may be of various shapes, including cylindrical, trapezoidal, and elliptical, etc.

The conductive plate 7*b* may rotate integrally with the nonconductive plate 7*a*, being fixed into the grooves of the nonconductive plate 7*a*, or may rotate at a rotational linear velocity different from that of the nonconductive plate 7*a*, being inserted but not fixed into the grooves of the nonconductive plate 7*a*.

When nanofibers are spun onto the collector 7, the nanofibers are collected only on the conductive plate 7*b*, thus preparing a ribbon-shaped nanofiber web 16. The nanofibers collected on the conductive plate 7*b* are oriented well in the fiber axis direction by the conductive plate 7*b* advancing forward, thereby exhibiting good focusability and drawability in the subsequent processes.

Preferably, the width (u) and depth (h) of the grooves formed at regular intervals along the lengthwise direction of the nonconductive plate 7*a* are adjusted according to the thickness of a continuous filament to be produced.

The width (u) of the grooves is preferably 0.1 to 20 mm, more preferably, 1 to 15 mm, and the depth (h) of the grooves is 0.1 to 50 mm, more preferably, 1 to 30 mm.

If the width (u) is less than 0.1 mm, it is difficult to handle with nanofibers because the amount of nanofibers to be collected is too small. If the width (u) exceeds 20 mm, the nanofibers may not be aligned (oriented) well in the fiber axis direction, thereby deteriorating the mechanical properties of the continuous filament.

If the depth (h) is less than 0.1 mm, the orientation of nanofibers is deteriorated due to the nanofibers scattered during electrospinning. If the depth (h) exceeds 50 mm, the distance from the nozzles 5 becomes too far and the volatilization space of a solvent becomes too small, which may deteriorate the nanofiber forming properties.

Preferably, the width (u') and height (h') of the conductive plate 7*a* of the shape as shown in FIG. 4 are adjusted according to the thickness of a continuous filament to be produced.

The width (u') of the conductive plate is preferably 0.1 to 20 mm, more preferably, 1 to 15 mm, and the depth (h') of the conductive plate is 0.1 to 50 mm, more preferably, 1 to 30 mm.

If the width (u') is less than 0.1 mm, it is difficult to handle with nanofibers because the amount of nanofibers to be collected is too small. If the width (u') exceeds 20 mm, the nanofibers may not be aligned (oriented) well in the fiber axis direction, thereby deteriorating the mechanical properties of the continuous filament.

If the height (h') is less than 0.1 mm, the orientation of nanofibers is deteriorated due to the nanofibers scattered during electrospinning. If the height (h') exceeds 50 mm, the nanofibers are attached to the lateral sides of the conductive plate and the fiber orientation is remarkably decreased, which may reduce the spinnability.

The nonconductive plate 7*a* is made of quartz, glass, polymer film, and polymer plate, etc. and the conductive plate 7*b* is made of inorganic materials, such as copper or gold, or polymers having excellent conductivity. In order to spin nanofibers at unit width, it is preferred to align the nozzles 5 in a row on the nozzle block 4 in the fiber advancing direction in conformity with the thickness of a filament to be produced, however, they may be aligned in two or more rows as necessary.

As the electrospinning technique, (I) a bottom-up electrospinning technique in which a nozzle block is disposed at a lower portion of a collector may be used, (II) a top-down electrospinning technique in which a nozzle block is disposed at an upper portion of a collector may be used, or (III) a horizontal electrospinning technique in which a nozzle block and a collector are disposed horizontally or at a near-horizontal angle.

More preferably, the bottom-up electrospinning technique is used for mass production.

It is possible to produce a continuous filament made up of hybrid nanofibers by electrospinning two or more kinds of polymer spinning solutions onto the same collector 7 via the nozzles 5 arranged in each nozzle block at the time of electrospinning.

A heater is installed at the nozzle block 4 for providing good nanofiber forming properties. Further, in the event of a long time spinning, or in the event of a long time accumulation when a spinning solution containing an inorganic oxide is spun, gelation occurs. To prevent this, it is good to perform agitation of the spinning solution by using an agitator 10*c* connected to agitator motor 10*a* via a nonconducting rod 10*b* midway between them.

Next, the ribbon-shaped nanofiber web 16 formed on the collector 7 is isolated (separated) from the collector 7 by using web feed rollers 15 and 17, and then focused, drawn and heat-treated, thereby producing a continuous filament made up of nanofibers.

During the isolation (separation) process of the ribbon-shaped nanofiber web 16 from the collector 7, as shown in FIG. 1, it is preferred to continuously or discontinuously coat or spray a nanofiber web separating solution 13 on the collector 7.

The nanofiber web isolating solution 13 may include water, methanol, ethanol, toluene, methylene chloride, a cation surfactant, an anion surfactant, a binary (cation-anion) surfactant, or a neutral surfactant, etc.

Continually, the nanofiber web 16 isolated (separated) from the collector 7 is focused while passing through a focusing device 18 utilizing a pressurized fluid or air, then drawn while passing through a first roller 19 and a second roller 20 by using the difference in rotational linear velocity between them, then heat-treated and solvent-removed while passing through a heat treatment device 21, then passes through a third roller 22, and then a drawn continuous filament is wound around a bobbin 23.

It is also possible to produce a nanofiber filament composed of different components by doubling nanofiber filaments of different components prepared by electrospinning different polymer solutions according to the present invention, or by conjugated-spinning using a nozzle block of composite nozzles.

Besides, it is also possible to produce a hollow fiber by conjugated-spinning different polymer solutions in a core/shell format and then dissolving out the core component therefrom.

Advantageous Effects

The present invention can produce a continuous filament made up of nanofibers by a simpler continuous process which is excellent in drawability because the fibers are well aligned in the fiber axis direction.

EXPLANATION OF REFERENCE NUMERALS OF MAIN PARTS OF THE DRAWINGS

Figure 1:
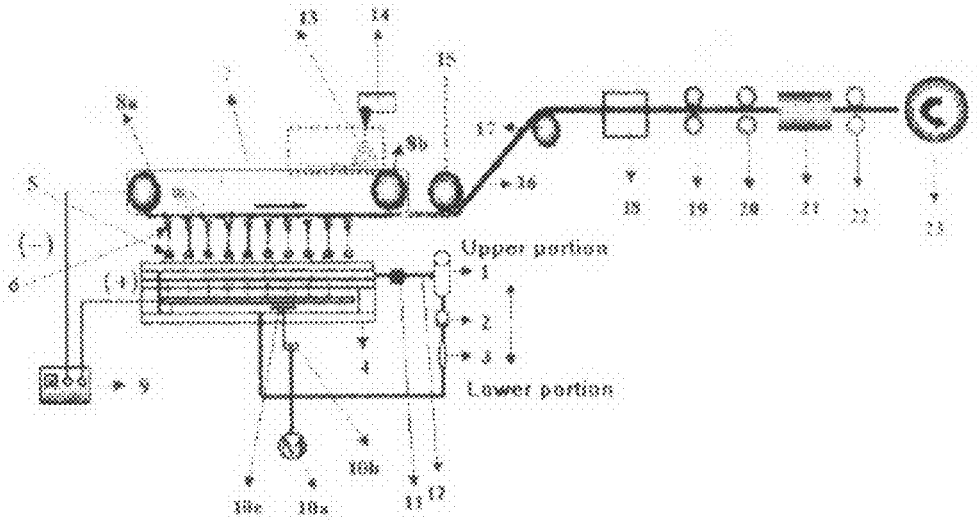
FIG. 1 is a schematic view of a process using the bottom-up method according to the present invention.
Figure 2:
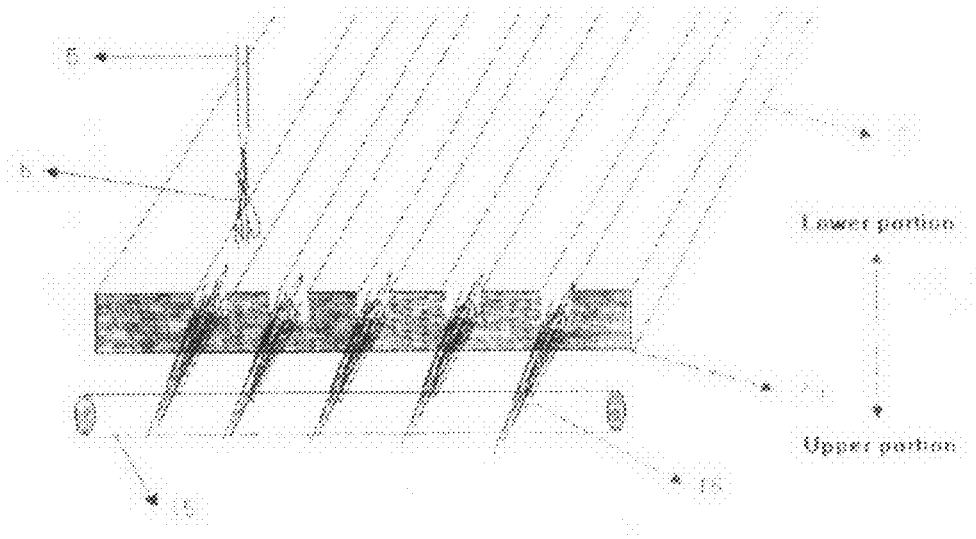
FIG. 2 is a pattern diagram showing a process for producing a ribbon-shaped nanofiber web at a collector 7 where a conductive plate 7*b* is disposed within grooves of a nonconductive plate 7*a;*

1: spinning solution storage tank 2: metering pump 3: spinning solution dropping device 4: nozzle block 5: nozzle 6: nanofiber 7: collector 7*a*: nonconductive plate of collector 7*b*: conductive plate of collector 8*a*,8*b*: collector supporting rod 9: high voltage generator 10*a*: agitator motor 10*b*: nonconducting rod 10*c*: agitator 11: overflow solution suctioning device 12: transfer tube 13: nanofiber web separating solution 14: separating liquid storage tank 15: web feed roller 16: ribbon-shaped nanofiber web 17: web feed roller 18: focusing device (using fluid or air) 19: first roller 20: second roller 21: heat treatment device (solvent removal device) 22: third roller 23: bobbin with produced continuous filament wound therearound u: width of grooves formed on nonconductive plate 7*a* h: depth of grooves formed on nonconductive plate 7*a* u': width of conductive plate 7*b* h': height of conductive plate

BEST MODE FOR CARRYING OUT THE INVENTION

Example 1

A polymer spinning solution was prepared by melting nylon resin having a relative viscosity of 3.2, measured in a 96% sulfuric acid solution, in formic acid at a concentration of 15% by weight.

The surface tension of the polymer spinning solution was 49 mN/m, the solution viscosity was 40 centipoises, and the electric conductivity was 420 mS/m.

Figure 3:
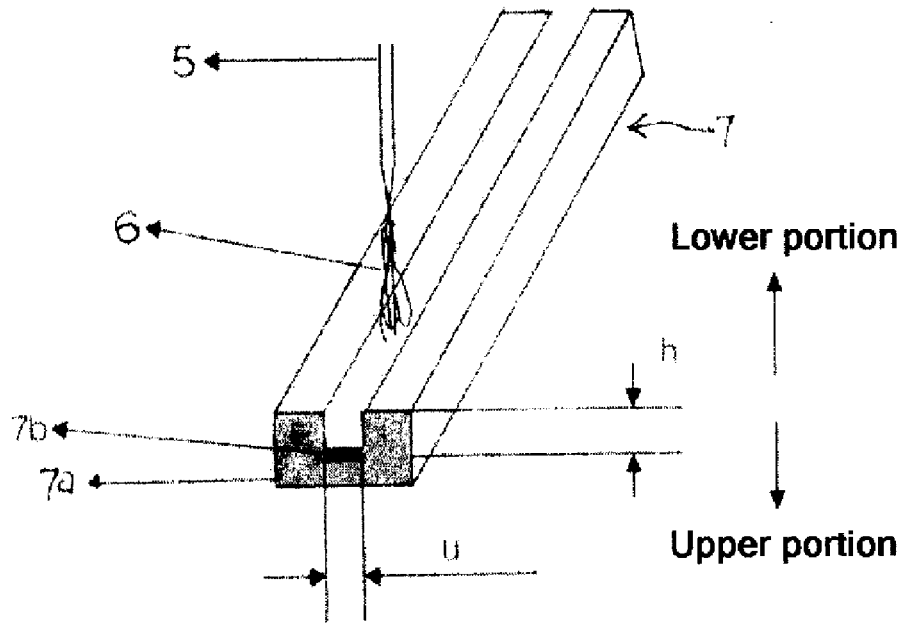
FIG. 3 is an enlarged pattern diagram of parts of the collector 7 as shown in FIG. 2.

The polymer spinning solution was supplied to nozzles 5 within a nozzle block 4 of a bottom-up electrospinning apparatus as shown in FIG. 1 through a metering pump 2, and then electrospun onto a collector 7 having a shape as shown in FIG. 3 via the nozzles 5, the collector 7 consisting of (I) a nonconductive plate 7*a* made of toughened glass with eight grooves having a 7 mm width and a 6 mm length formed along a lengthwise direction and (II) a conductive plate 7*b* having a 6.9 mm width inserted and fixed into respective grooves.

At this time, the nozzle block 4 used in this embodiment as a nozzle block has 16,000 nozzles in total and consists of eight unit nozzle blocks where 2,000 nozzles with a diameter of 1 mm were aligned in a row. The discharge amount per nozzle was 1.2 mg/min, the voltage was 28 kV, and the spinning distance was 16 cm.

Next, a nanofiber web focused in a ribbon shape on the collector was separated (isolated) from the collector 7 by using web feed rollers 15 and 17 having a rotational linear velocity of 80 m/min. Then, the separated nanofiber web was passed through a focusing device 18 and focused, and then drawn while sequentially passing through a first roller 19 having a rotational linear velocity of 82 m/min, a second roller 20 having a rotational linear velocity of 285 m/min and a third roller 22 having a rotational linear velocity of 295 m/min.

In addition, the nanofiber web was heat-set at a 170° C. in a heat treatment device 21 installed between the second roller 20 and the third roller 22, and wound at a winding speed of 290 m/min, thereby producing a continuous filament made up of nanofibers.

The fineness of the produced continuous filament was 75 deniers, the strength was 4.5 g/denier, the elongation was 42%, and the diameter of the nanofibers was 186 nm.

Figure 5:
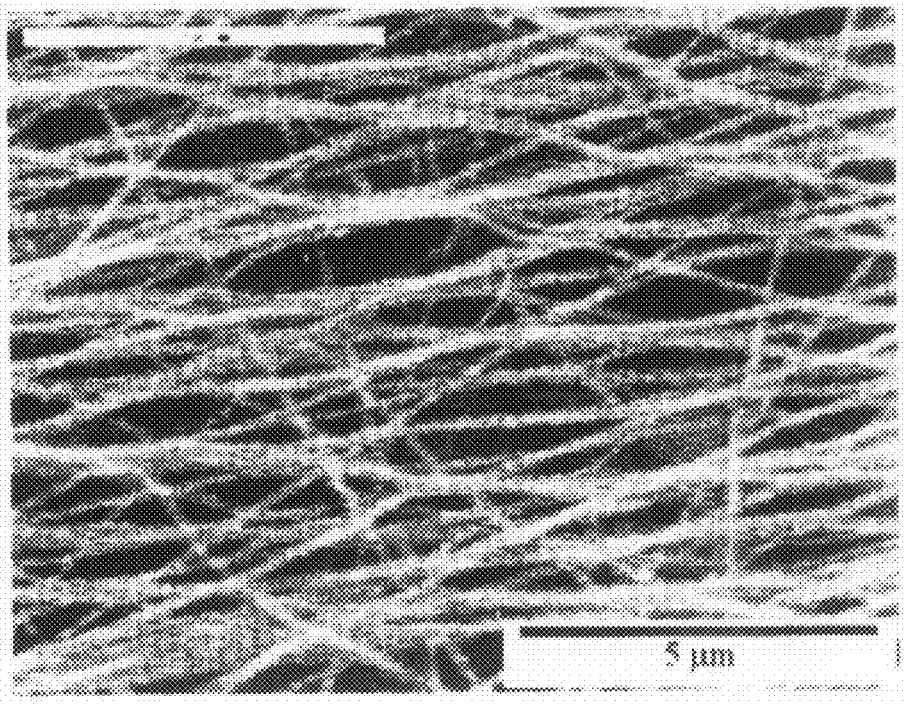
FIG. 5 is an electron micrograph of a continuous filament produced according to Example 1, which shows the nanofibers of the continuous filament being well aligned in the fiber axis direction.

The electron micrograph of the produced filament is as shown in FIG. 5.

The nanofibers of the produced continuous filament were aligned well in the fiber axis direction as shown in FIG. 5.

Example 2

A polymer spinning solution was prepared by melting nylon resin having a relative viscosity of 3.2, measured in a 96% sulfuric acid solution, in formic acid at a concentration of 15% by weight.

The surface tension of the polymer spinning solution was 49 mN/m, the solution viscosity was 40 centipoises, and the electric conductivity was 420 mS/m.

The polymer spinning solution was supplied to nozzles 5 within a nozzle block 4 of a bottom-up electrospinning apparatus as shown in FIG. 1 through a metering pump 2, and then electrospun onto a collector 7 having a shape as shown in FIG. 3 via the nozzles 5, the collector 7 consisting of (I) a nonconductive plate 7*a* made of toughened glass with eight grooves having a 7 mm width and a 6 mm length formed along a lengthwise direction and (II) a conductive plate 7*b* which is inserted into the respective grooves, self-rotate and has a 6.8 mm width.

At this time, the rotational linear velocity of the conductive plate 7*b* was 80 m/min.

At this time, the nozzle block 4 used in this embodiment as a nozzle block has 16,000 nozzles in total and consists of eight unit nozzle blocks where 2,000 nozzles with a diameter of 1 mm were aligned in a row. The discharge amount per nozzle was 1.2 mg/min, the voltage was 28 kV, and the spinning distance was 16 cm.

Next, a nanofiber web focused in a ribbon shape on the collector was separated (isolated) from the collector 7 by using web feed rollers 15 and 17 having a rotational linear velocity of 80 m/min. Then, the separated nanofiber web was passed through a focusing device 18 and focused, and then drawn while sequentially passing through a first roller 19 having a rotational linear velocity of 82 m/min, a second roller 20 having a rotational linear velocity of 285 m/min and a third roller 22 having a rotational linear velocity of 295 m/min.

In addition, the nanofiber web was heat-set at a 170° C. in a heat treatment device 21 installed between the second roller 20 and the third roller 22, and wound at a winding speed of 290 m/min, thereby producing a continuous filament made up of nanofibers.

The fineness of the produced continuous filament was 75 deniers, the strength was 5.1 g/denier, the elongation was 35%, and the diameter of the nanofibers was 176 nm.

Example 3

A spinning solution was prepared by melting polyurethane resin having a molecular weight of 80,000 and polyvinyl chloride having a polymerization degree of 800 at a weight ratio of 70:30 in a mixed solvent of dimethylformamide and tetrahydrofuran (volume ratio: 5/5).

The viscosity of the spinning solution was 450 centipoises.

The polymer spinning solution was supplied to nozzles 5 within a nozzle block 4 of a bottom-up electrospinning apparatus as shown in FIG. 1 through a metering pump 2, and then electrospun onto a collector 7 having a shape as shown in FIG. 3 via the nozzles 5, the collector 7 consisting of (I) a nonconductive plate 7*a* made of toughened glass with eight grooves having a 7 mm width and a 6 mm length formed along a lengthwise direction and (II) a conductive plate 7*b* having a 6.9 mm width inserted and fixed into the respective grooves.

At this time, the nozzle block 4 used in this embodiment as a nozzle block has 16,000 nozzles in total and consists of eight unit nozzle blocks where 2,000 nozzles with a diameter of 1 mm were aligned in a row. The discharge amount per nozzle was 2.0 mg/min, the voltage was 35 kV, and the spinning distance was 20 cm.

Next, a nanofiber web focused in a ribbon shape on the collector was separated (isolated) from the collector 7 by using web feed rollers 15 and 17 having a rotational linear velocity of 145 m/min. Then, the separated nanofiber web was passed through a focusing device 18 and focused, and then drawn while sequentially passing through a first roller 19 having a rotational linear velocity of 149 m/min, a second roller 20 having a rotational linear velocity of 484 m/min and a third roller 22 having a rotational linear velocity of 490 m/min.

In addition, the nanofiber web was heat-set at a 110° C. in a heat treatment device 21 installed between the second roller 20 and the third roller 22, and wound at a winding speed of 486 m/min, thereby producing a continuous filament made up of nanofibers.

The fineness of the produced continuous filament was 75 deniers, the strength was 3.4 g/denier, the elongation was 45%, and the diameter of the nanofibers was 480 nm.

Example 4

A polymer spinning solution was prepared by melting nylon resin having a relative viscosity of 3.2, measured in a 96% sulfuric acid solution, in formic acid at a concentration of 15% by weight.

The surface tension of the polymer spinning solution was 49 mN/m, the solution viscosity was 40 centipoises, and the electric conductivity was 420 mS/m.

Figure 4:
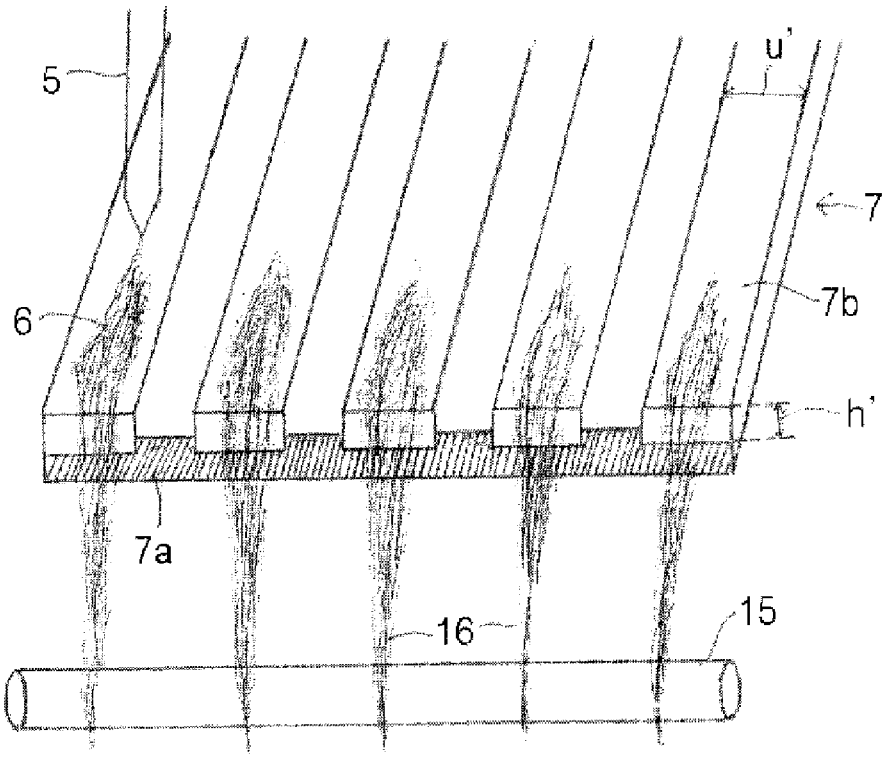
FIG. 4 is a pattern diagram showing a process for producing a ribbon-shaped nanofiber web at a collector 7 where a conductive plate 7*b* is projected on the surface of a nonconductive plate 7*a;*

The polymer spinning solution was supplied to nozzles 5 within a nozzle block 4 of a bottom-up electrospinning apparatus as shown in FIG. 1 through a metering pump 2, and then electrospun onto a collector 7 having a shape as shown in FIG. 4 via the nozzles 5, the collector 7 consisting of (I) a nonconductive plate 7*a* made of toughened glass with eight grooves having a 4.1 mm width formed along a lengthwise direction and (II) eight conductive plates 7*b* made of copper which are inserted and fixed into the respective grooves, projected on the surface of the nonconductive plate and have a 4 mm width (u) and a 5 mm height (h')

At this time, the nozzle block 4 used in this embodiment as a nozzle block has 16,000 nozzles in total and consists of eight unit nozzle blocks where 2,000 nozzles with a diameter of 1 mm were aligned in a row. The discharge amount per nozzle was 1.2 mg/min, the voltage was 28 kV, and the spinning distance was 16 cm.

Next, a nanofiber web focused in a ribbon shape on the collector was separated (isolated) from the collector 7 by using web feed rollers 15 and 17 having a rotational linear velocity of 80 m/min. Then, the separated nanofiber web was passed through a focusing device 18 and focused, and then drawn while sequentially passing through a first roller 19 having a rotational linear velocity of 82 m/min, a second roller 20 having a rotational linear velocity of 285 m/min and a third roller 22 having a rotational linear velocity of 295 m/min.

In addition, the nanofiber web was heat-set at a 170° C. in a heat treatment device 21 installed between the second roller 20 and the third roller 22, and wound at a winding speed of 290 m/min, thereby producing a continuous filament made up of nanofibers.

The fineness of the produced continuous filament was 75 deniers, the strength was 4.5 g/denier, the elongation was 42%, and the diameter of the nanofibers was 186 nm.

Example 5

A polymer spinning solution was prepared by melting nylon resin having a relative viscosity of 3.2, measured in a 96% sulfuric acid solution, in formic acid at a concentration of 15% by weight.

The surface tension of the polymer spinning solution was 49 mN/m, the solution viscosity was 40 centipoises, and the electric conductivity was 420 mS/m.

The polymer spinning solution was supplied to nozzles 5 within a nozzle block 4 of a bottom-up electrospinning apparatus as shown in FIG. 1 through a metering pump 2, and then electrospun onto a collector 7 having a shape as shown in FIG. 4 via the nozzles 5, the collector 7 consisting of (I) a nonconductive plate 7*a* made of Teflon with eight grooves having a 4.1 mm width formed along a lengthwise direction and (II) eight conductive plate 7*b* made of copper which are inserted into the respective grooves, projected on the surface of the nonconductive plate, self-rotate and have a 4 mm width (u') and a 5 mm height (h').

At this time, the rotational linear velocity of the conductive plate 7*b* was 80 m/min.

At this time, the nozzle block 4 used in this embodiment as a nozzle block has 16,000 nozzles in total and consists of eight unit nozzle blocks where 2,000 nozzles with a diameter of 1 mm were aligned in a row. The discharge amount per nozzle was 1.2 mg/min, the voltage was 28 kV, and the spinning distance was 16 cm.

Next, a nanofiber web focused in a ribbon shape on the collector was separated (isolated) from the collector 7 by using web feed rollers 15 and 17 having a rotational linear velocity of 80 m/min. Then, the separated nanofiber web was passed through a focusing device 18 and focused, and then drawn while sequentially passing through a first roller 19 having a rotational linear velocity of 82 m/min, a second roller 20 having a rotational linear velocity of 285 m/min and a third roller 22 having a rotational linear velocity of 295 m/min.

In addition, the nanofiber web was heat-set at a 170° C. in a heat treatment device 21 installed between the second roller 20 and the third roller 22, and wound at a winding speed of 290 m/min, thereby producing a continuous filament made up of nanofibers.

The fineness of the produced continuous filament was 75 deniers, the strength was 5.3 g/denier, the elongation was 33%, and the diameter of the nanofibers was 173 nm.

Example 6

A spinning solution was prepared by melting polyurethane resin having a molecular weight of 80,000 and polyvinyl chloride having a polymerization degree of 800 at a weight ratio of 70:30 in a mixed solvent of dimethylformamide and tetrahydrofuran (volume ratio: 5/5).

The viscosity of the spinning solution was 450 centipoises.

The polymer spinning solution was supplied to nozzles 5 within a nozzle block 4 of a bottom-up electrospinning apparatus as shown in FIG. 1 through a metering pump 2, and then electrospun onto a collector 7 having a shape as shown in FIG. 4 via the nozzles 5, the collector 7 consisting of (I) a nonconductive plate 7*a* made of Teflon with eight grooves having a 6.1 mm width formed along a lengthwise direction and (II) eight conductive plates 7*b* made of copper which are inserted and fixed into the respective grooves, projected on the surface of the nonconductive plate and have a 6 mm width (u') and a 5 mm height (h').

At this time, the nozzle block 4 used in this embodiment as a nozzle block has 16,000 nozzles in total and consists of eight unit nozzle blocks where 2,000 nozzles with a diameter of 1 mm were aligned in a row. The discharge amount per nozzle was 2.0 mg/min, the voltage was 35 kV, and the spinning distance was 20 cm.

Next, a nanofiber web focused in a ribbon shape on the collector was separated (isolated) from the collector 7 by using web feed rollers 15 and 17 having a rotational linear velocity of 145 m/min. Then, the separated nanofiber web was passed through a focusing device 18 and focused, and then drawn while sequentially passing through a first roller 19 having a rotational linear velocity of 149 m/min, a second roller 20 having a rotational linear velocity of 484 m/min and a third roller 22 having a rotational linear velocity of 490 m/min.

In addition, the nanofiber web was heat-set at a 110° C. in a heat treatment device 21 installed between the second roller 20 and the third roller 22, and wound at a winding speed of 486 m/min, thereby producing a continuous filament made up of nanofibers.

The fineness of the produced continuous filament was 75 deniers, the strength was 3.6 g/denier, the elongation was 42%, and the diameter of the nanofibers was 456 nm.

Figure 6:
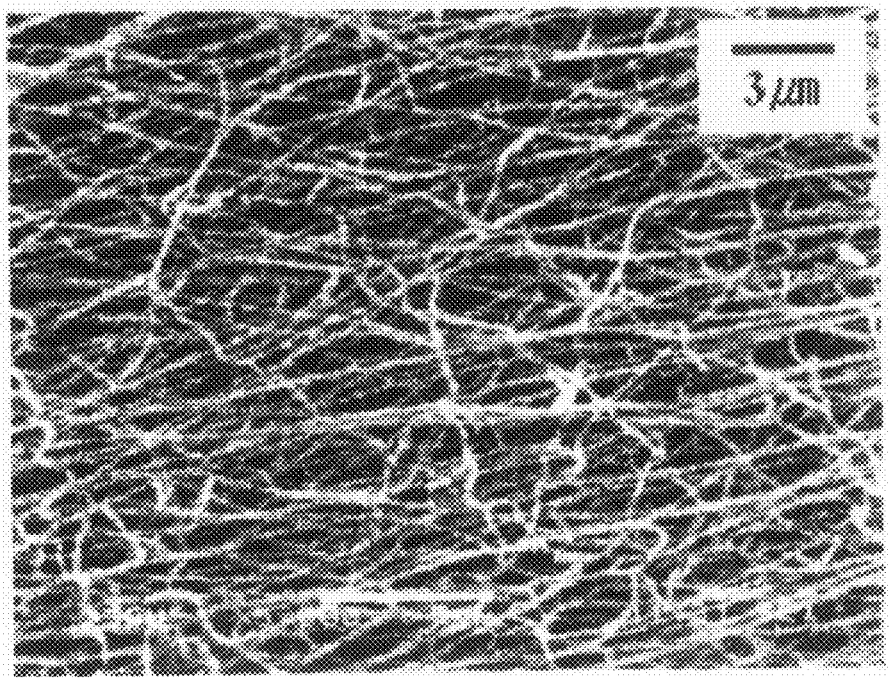
FIG. 6 is an electron micrograph of a continuous filament produced according to Example 6, which shows the nanofibers of the continuous filament being well aligned in the fiber axis direction.

FIG. 6 is an electron micrograph of a continuous filament produced according to Example 6, which shows the nanofibers of the continuous filament being well aligned in the fiber axis direction.

INDUSTRIAL APPLICABILITY

The continuous filament produced according to the present invention is improve in properties and useful as materials for various types of industrial applications, including artificial dialysis filters, artificial vessels, and anti-adhesion agent, etc. as well as daily necessaries, such as artificial leather, air cleaning filters, wiping cloths, golf gloves, and wigs, etc.

What is claimed is:

1. A process of preparing a continuous filament composed of nanofibers, wherein a ribbon-shaped nanofiber web is prepared by electrospinning a polymer spinning solution onto a collector applied with a high voltage, the collector including an endless belt type nonconductive plate with grooves having a predetermined width (u) and depth (h) formed at regular intervals along a lengthwise direction and a conductive plate inserted into the grooves of the nonconductive plate, and then the nanofiber web is isolated from the collector, focused, drawn and wound.

2. The process of claim 1, wherein the conductive plate rotates integrally with the nonconductive plate, being fixed into the grooves of the nonconductive plate.

3. The process of claim 1, wherein the conductive plate rotates at a rotational linear velocity different from that of the nonconductive plate, being inserted but not fixed into the grooves of the nonconductive plate.

4. The process of claim 1, wherein the width (u) of the grooves formed at regular intervals along the lengthwise direction of the nonconductive plate is 0.1 to 20 mm.

5. The process of claim 1, wherein the depth (h) of the grooves formed at regular intervals along the lengthwise direction of the nonconductive plate is 0.1 to 50 mm.

6. The process of claim 1, wherein the conductive plate is projected on the surface of the nonconductive plate.

7. The process of claim 6, wherein the width (u') of the conductive plate is 0.1 to 20 mm.

8. The process of claim 6, wherein the height (h') of the conductive plate is 0.1 to 50 mm.

9. The process of claim 6, wherein the conductive plate is cylindrical, trapezoidal or elliptical in shape.

10. The process of claim 1, wherein the electrospinning technique is any one of (I) a bottom-up electrospinning technique in which a nozzle block is disposed at a lower portion of a collector, (II) a top-down electrospinning technique in which a nozzle block is disposed at an upper portion of a collector, or (III) a horizontal electrospinning technique in which a nozzle block and a collector are disposed horizontally or at a near-horizontal angle.

11. The process of claim 1, wherein a nanofiber web separating solution is continuously or discontinuously coated or sprayed on the collector where nanofibers are electrospun.

12. The process of claim 11, wherein the nanofiber web separating solution is any one of water, methanol, ethanol, toluene, methylene chloride, a cation surfactant, an anion surfactant, a binary surfactant, or a neutral surfactant.

13. The process of claim 1, wherein the ribbon-shaped nanofiber web isolated from the collector is focused while passing through a focusing device utilizing a pressurized fluid or air.

14. The process of claim 1, wherein the focused nanofiber web is drawn between two rollers by using the difference in rotational velocity between the rollers.

15. The process of claim 1, wherein a drawn nanofiber filament is heat-treated.

* * * * *